US005209352A

United States Patent [19]

Light et al.

[11] Patent Number: 5,209,352

[45] Date of Patent: May 11, 1993

[54] BARRIER PACKAGE FOR PHOTOGRAPHIC FILM PRODUCTS

[75] Inventors: Susan L. Light, Webster; Luke T. Faulstick, Rochester; William G. Hoyt, Churchville, all of N.Y.

[73] Assignee: Eastman Kodak Company, Rochester, N.Y.

[21] Appl. No.: 814,381

[22] Filed: Dec. 26, 1991

[51] Int. Cl.[5] ..... B65B 85/672

[52] U.S. Cl. ..... 206/391; 206/443; 206/455; 206/485; 206/564

[58] Field of Search ..... 206/391, 393, 443, 446, 206/455, 461, 467, 469, 471, 485, 486, 564, 811

[56] References Cited

U.S. PATENT DOCUMENTS

| | | | |
|---|---|---|---|
| 3,707,227 | 12/1972 | Britt | 206/443 |
| 4,180,192 | 12/1979 | Breslau | 206/391 X |
| 4,324,331 | 4/1982 | Ignasiak | 206/461 X |
| 4,341,308 | 7/1982 | Pasquini | 206/485 X |
| 4,375,850 | 3/1983 | Smyth et al. | 206/471 X |
| 4,461,384 | 7/1984 | Erlam | 206/485 X |
| 4,723,655 | 2/1988 | Schreiber | 206/391 |
| 4,796,756 | 1/1989 | Ott | 206/564 X |
| 4,826,005 | 5/1989 | Tajima et al. | 206/485 X |
| 4,958,731 | 9/1990 | Calcerano | 206/471 X |
| 4,986,414 | 1/1991 | Ashley et al. | 206/564 X |
| 4,991,717 | 2/1991 | May et al. | 206/455 |
| 5,048,684 | 9/1991 | Scott | 206/471 X |

*Primary Examiner*—Steven N. Meyers
*Assistant Examiner*—Jacob K. Ackun, Jr.
*Attorney, Agent, or Firm*—Clyde E. Bailey

[57] ABSTRACT

A package structure 10 for storing and transporting photographic film magazines comprises a container 12 having a open end 24 and a base 14 supporting opposing end walls 16 and opposing side walls 20,24. Side walls 20,22 have a plurality of spaced apart recesses 32,34, respectively, forming chambers or receptacles 30, for frictionally receiving the end portion and the hub extending from the opposite end portion of the 135 photographic film magazines disposed therein. A lid member 26, made from a flexible opaque laminate material environmentally compatible with the container 12, is hermetically sealed to a flange member 42 formed in the top edge 28 of the end and side walls 16,20,22. The sealed package 10 protects the enclosed product from deleterious environmental effects, such as dirt, light and moisture, and is convenient to use.

4 Claims, 4 Drawing Sheets

BARRIER PACKAGE FOR PHOTOGRAPHIC FILM PRODUCTS

FIELD OF THE INVENTION

The invention relates generally to a package structure, and more particularly to a multiple tray package for storing and transporting photosensitive film in an environment substantially free of dirt, moisture and light.

BACKGROUND OF THE INVENTION

Conventional 35 mm film magazines have both primary and secondary packaging structures. Product protection and user utility is provided by the primary package structure which is typically a combination can and cap arrangement. The can and cap combination provides a barrier to light, moisture and dirt such that the film contained therein is fit for use by the photographer. Another function of the can is to protect the film leader and magazine from abrasion. The secondary package structure is typically a carton that imparts stackability and offers product advertising and communication opportunities. The can and cap combination is loaded into various carton configurations to provide various sale quantities to the customer.

Photographers on location using multiple film rolls often discard the conventional packaging, given its bulky nature, rather than saving it on their person as a carrying device for exposed film rolls. Thus, the present combination of cans, caps and cartons results in enormous amounts of packaging waste with which the consumer must contend. Moreover, professional photographers using 135 film products have unique requirements for convenience of use. These requirements typically involve the need to carry multiple rolls of film products, the need to access those film products quickly for camera loading in fast action settings, and the need to conveniently retain and contain the exposed film on their person. Thus, with the present 35 mm film packages, the photographer can not easily maintain control of exposed film magazines and must find a convenient place to store exposed film magazines. Moreover, 35 mm film has a photosensitive leader that interacts with the camera which must be protected from damage during storage. Prior art packages complicate meeting the photographer's requirements because of their inherently bulky and complex nature.

U.S. Pat. No. 4,732,655 teaches a container to carry multiple 35 mm film cartridges and/or spools of material. The package has a complex screw type lid which would be difficult to adapt to the need of photographers for convenience of use. Moreover, while the container protects the product from x-rays, the deleterious effects of dirt, moisture and light on the product are not addressed.

SUMMARY OF THE INVENTION

It is, therefore, an object of the invention to provide a package structure having improved convenience of use while protecting the enclosed product from moisture, light and dirt.

Accordingly, for accomplishing these and other objects of the invention, there is provided a package structure for storing and transporting photographic film magazines in an environment substantially free of moisture and light comprising a container having an openable end and a base. The base of the container supports a pair of opposed end walls and opposed side walls. The opposed side walls have a plurality of spaced apart recess portions defining chambers for frictionally receiving and securing end portions of the photographic film magazine. A lid member, which may be peelable, is bonded to the top edge of the container so that the enclosed articles are protected from the deleterious effects of the environment, such as light, moisture and dirt. The lid member and container materials are both substantially opaque and moisture resistant. The peelable lid member also provides easy access to the articles inside the container.

Thus, an important advantage of the present invention is that it provides a package having improved convenience of use while both protecting the enclosed product from deleterious environmental effects and significantly reducing the amount of packaging entering the solid waste stream.

BRIEF DESCRIPTION OF THE DRAWINGS

The foregoing as well as other objects, features and advantages of this invention will become more apparent from the appended figures wherein like reference numerals denote like elements, and wherein.

DETAILED DESCRIPTION OF THE PREFERRED EMBODIMENTS

Figure 1:
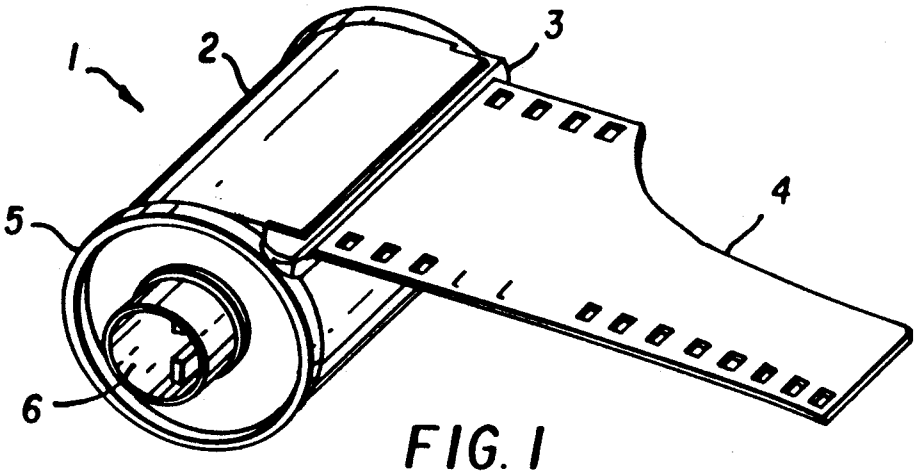
FIG. 1 is a perspective view of a 35 mm film magazine.

Film magazines adaptable to the package structure of the present invention include 35 mm film. FIG. 1 shows a perspective view of a 35 mm film magazine 1 having a retort 2 for protecting the photosensitive film and spaced lips 3 through which a film leader portion 4 projects for interaction with a camera. The projected film portion 4 is protected from damage in the package of the invention as described below. Moreover, 35 mm film magazine 1 has a pair of end portions (only one shown) with one end portion 5 having a hub 6 which extends radially from the end portion 5. A more complete description of the 35 mm film is provided in U.S. Pat. No. 2,940,232, incorporated herein by reference.

Figure 2:
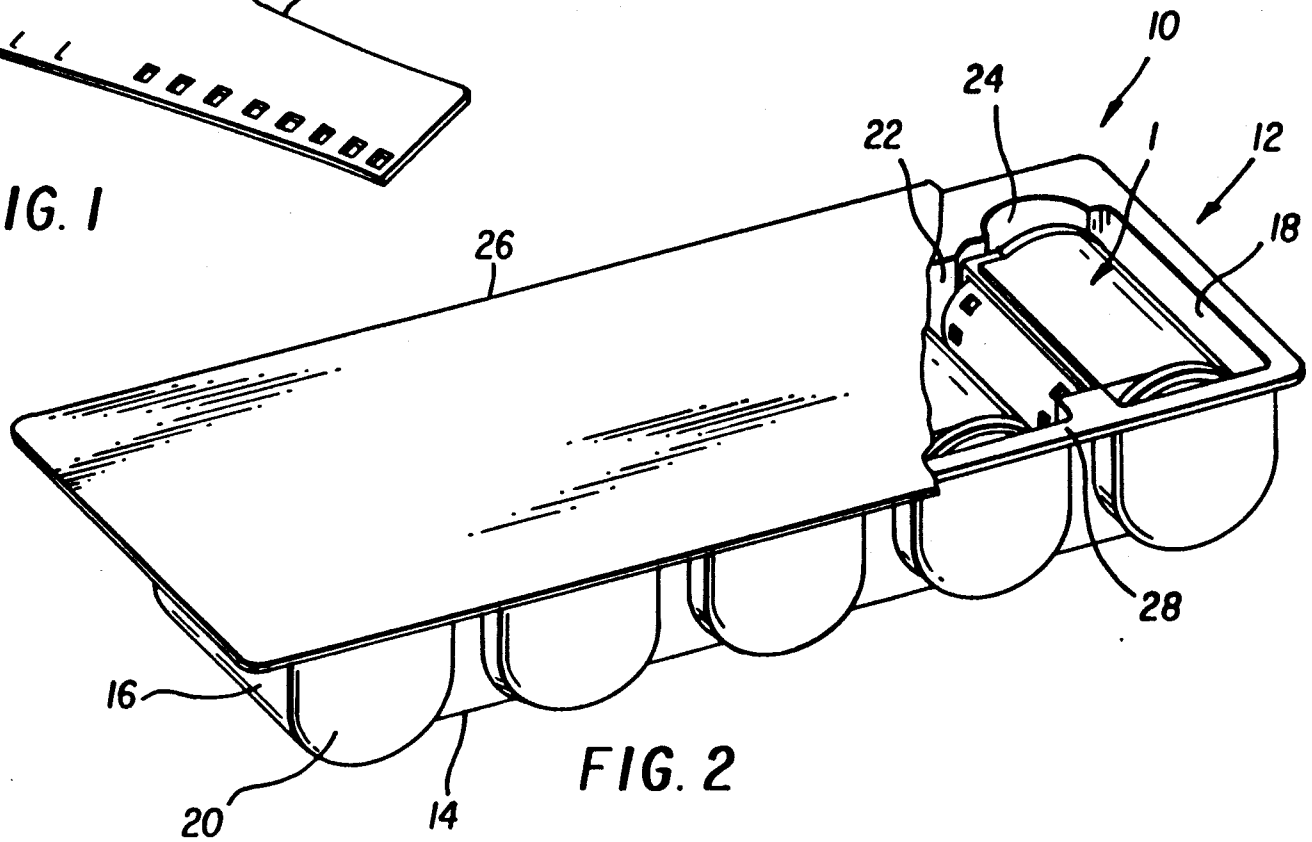
FIG. 2 is a perspective view, partially broken away, of the package structure of the present invention.
Figure 3:
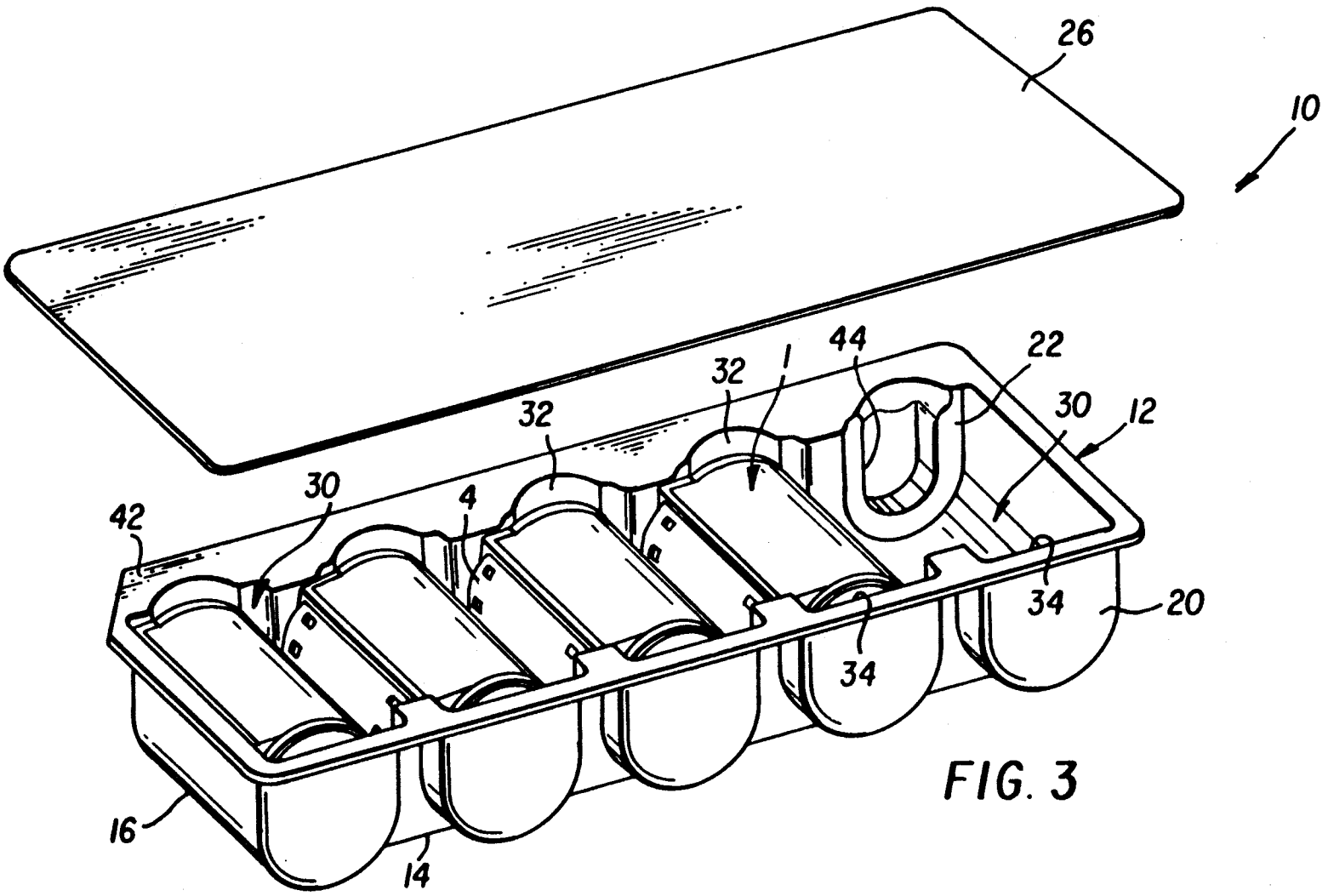
FIG. 3 is an exploded view showing the package of FIG. 2 having articles therein.

FIG. 2 shows a perspective view of the package 10 constructed according to the principles of the invention. Although package 10 is described as a container for photographic film magazines, it will be appreciated that the package can be utilized for other types of articles. Generally, package 10 comprises a tray or container 12 having a base 14, a pair of end walls 16, side walls 20,22, an open end 24 and a lid member 26 bonded to the entire periphery of its top edge 28, as described in more detail below. FIG. 3 shows package 10, with lid member 26 removed from container 12, having a plurality of chambers or receptacles 30 defined by recesses 32,34 in opposing side walls 20,22, for frictionally receiving and retaining the photographic film magazines 1. Container 12 has a depth sufficient to provide clearance between the film magazines and the lid member 26 and to prevent any heat transfer between lid member 26 and the film magazines 1. Container 12 is preferably formed by a vacuum thermoforming process wherein one large cavity is formed containing the molded features that will restrain, by frictional means, multiple film magazines. Those skilled in the art will appreciate that container 12 may also be formed by various other processes, e.g., injection molding. In the preferred embodiment, the container 12 is made from a semi-rigid, opaque polymeric material comprising black polyethylene (80%-wt. high density polyethylene, 20%-wt. low density polyethylene, 3%-wt. carbon), black high impact polystyrene (3%-wt. carbon), and natural polystyrene with an ethylene vinyl acid (EVA) tie layer for binding the polyethylene/polystyrene coextrusion. The thickness of the container walls is preferably at least about 0.040 inches (0.10160 cm.). It is, however, to be appreciated that container 12 thickness may vary depending upon material so long as the materials impart the required container strength and barrier protection. The preferred container material is a product of Portion Packaging Inc., located in Trevose, Pa. The package structure 10 is generally right rectangular parallelapiped in shape. As will be appreciated, other materials, such as poly(etylene terephthalate), polypropylene, polystyrene, high density polyethylene, polyester, polyvinyl chloride, surlyn ionomer, any coextrusion utilizing polyvinyl chloride or any substrate coated with Saran Latex emulsion coating or mixtures thereof, may be used in various proportions to achieve the barrier protection properties of the present package structure.

Figure 4:
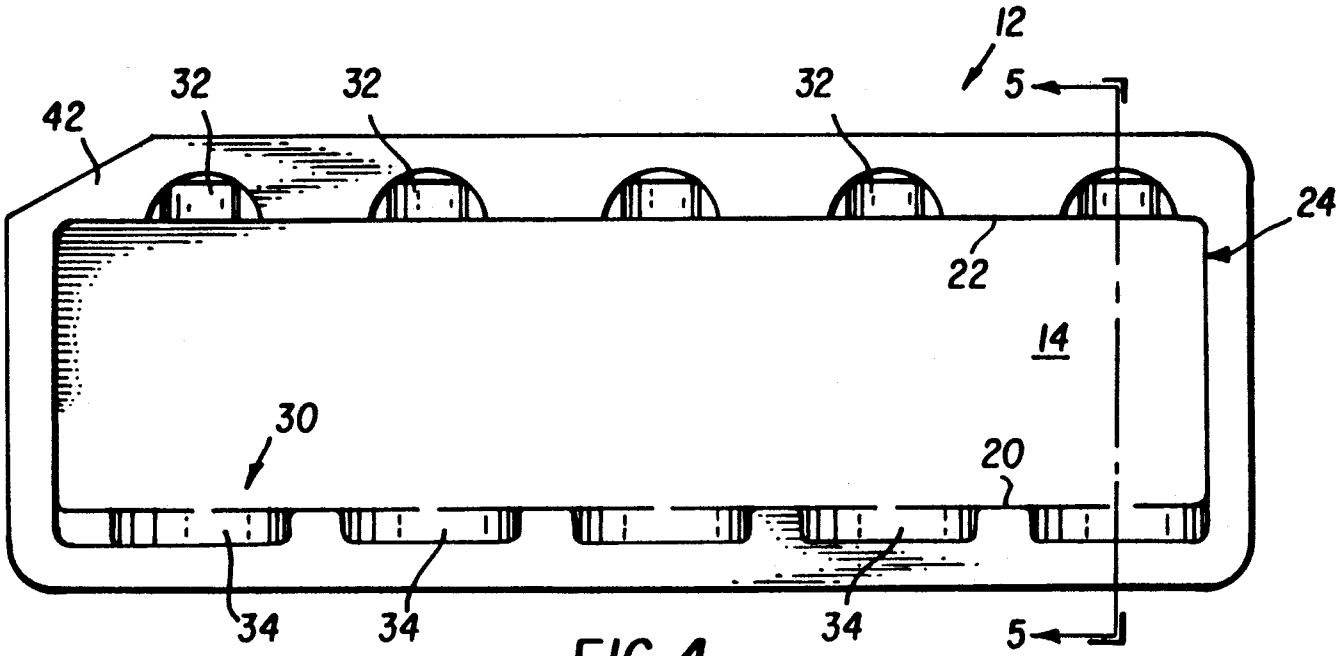
FIG. 4 is a top plan view of the package of FIG. 2.
Figure 6:
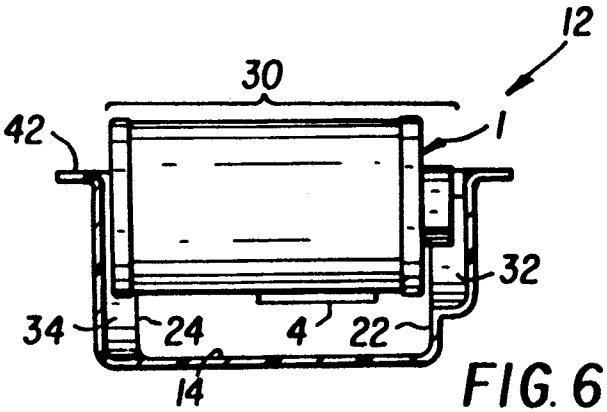
FIG. 6 is the view of FIG. 5 with an article partially disposed in the package.
Figure 5:
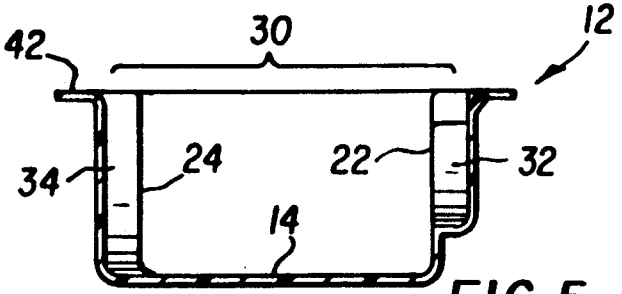
FIG. 5 is an end view in elevation, taken along line 5—5 of FIG. 4.
Figure 7:
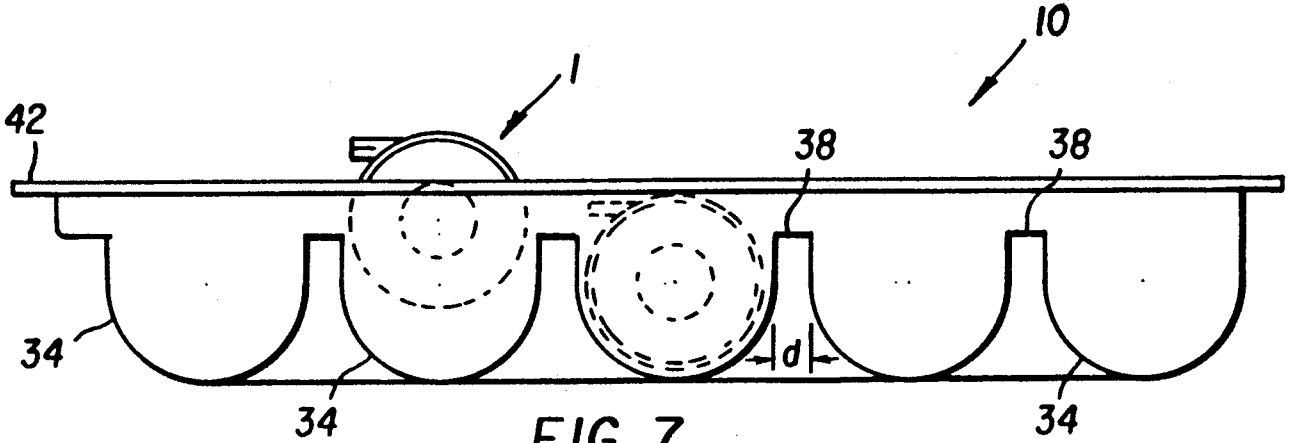
FIG. 7 is a front side view of FIG. 2.
Figure 8:
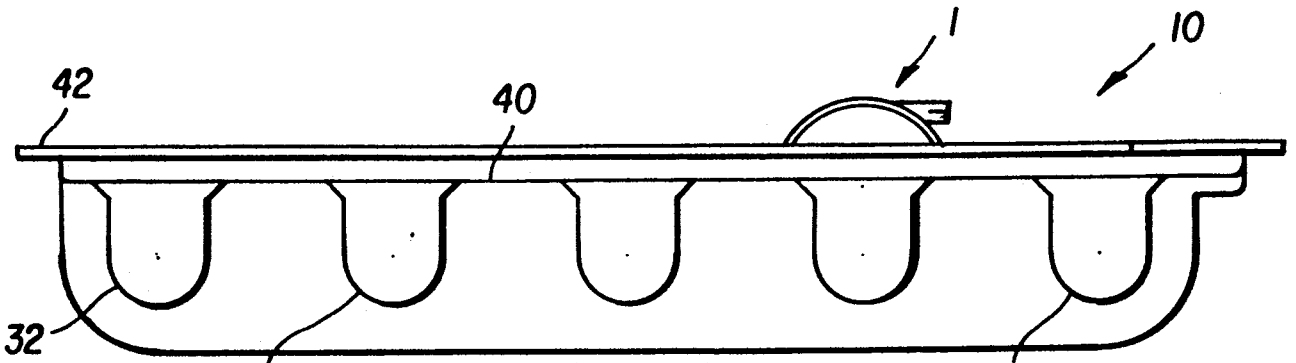
FIG. 8 is an rear side view of FIG. 2.

FIG. 4 shows a top view of container 12 exposing open end 24 for inserting film magazines and base 14. Base 14 is formed flat to create a flat exterior surface, not shown, for the application of a label or other suitable surface treatment that would accommodate textual information or provide users of package 10 with a surface for logging information relative to film usage and content. Base 14 supports a pair of opposed end walls 16 which are interconnected with and substantially normal to, adjacent opposed side walls 20,22 as best seen in FIG. 2. Each opposed side walls 20,22, has a plurality of spaced apart recesses 32,34 forming chambers or receptacles 30 for frictionally receiving and retaining multiple 35 mm film magazines. Moreover, recesses 32,34 in opposing side walls 20,22 are directly opposite one another on axis of the magazines. FIGS. 5 and 6 show end views of container 12 having a film magazine fully and partially disposed, respectively, in a receptacle 30. The receptacles 30 are spaced apart along the container 12 length, as shown in FIG. 8, so that adjacent articles in the container 12 do not contact one another thereby causing product abrasions or other damage. Moreover, the film magazine and leader are oriented in the container 12 such that the film leader is positioned beneath the film magazine at base 14 of container 12. The leader is thereby effectively retained and controlled, preventing interference with spacer 38,40 and a flange 42 formed in the top edge of the container 12. The longitudinal spacing (d) between adjacent receptacles 30 is such that no permanent curl or bend can be imparted to the film leader, which might adversely affect the film leader-camera interaction. Spacers 38,40, shown in FIG. 2, having spacing (d), extend upwardly from the base 14 along side walls 20,22 towards the open end 24 of container 12 terminate below flange 42, as shown in FIGS. 7 and 8. Recess portions 32, shown in FIG. 7, are substantially U-shaped and each has a width less the diameter of the film magazine end portion. Similarly, recess portions 34, shown in FIG. 8, are substantially U-shaped, and each has a width less than the diameter of the hub extending from the opposite end portion of the film magazine. Experiments indicate that the semi-rigid material comprising the container 12 which flex when an article is inserted in the receptacles 30 coupled with the substantially U-shaped configuration of recessed portions 32,34 having widths less than the dimensions of the inserted article together enable the article to frictionally fit securely in the receptacles 30 and reduce the opportunity for article damage when transported. Thus, the container 12 material promotes the interference fit of the film magazine in the receptacle 30. The frictional force used to retain the film magazines in receptacle 30 is of sufficient magnitude to prevent the film magazines from falling out of an inverted container 12, while still allowing easy removal of the film magazines. Those skilled in the art will appreciate the width of the recesses may be varied to accommodate the dimensions of any article contained in package 10. Thus, in a preferred embodiment, recess portions 32,34 in opposed side walls 20,22 respectively, are compatible with the shape of the end features of 35 mm film magazine as described in greater detail in U.S. Pat. No. 2,940,232. Further, as shown in FIG. 2, end portion guideways 42 are formed in recess portions 32 of side wall 22 for guiding the hub end of the magazine into the container 12. Guideways 44 each has a width greater than the width of each recess portion 32 and substantially equal to the diameter of the end portion of the film magazine guided therethrough. Therefore, each guideway 44 has a generally concentric relationship with its corresponding recess portion 32.

Flange 42 formed in the top edge 28 of end and side walls 16,20,22, respectively, is of sufficient width to insure a vapor-proof, hermetic seal between the flexible lid member 26 and flange 42 (FIG. 1). One end of flange 42 is cut at an angle to expose a corner portion 46 of the flexible lid member 26. The user can than grasp corner portion 46 and peel it off to expose the product. This is accomplished by pulling corner portion 46 away from the sealed flange 42 area and peeling flexible lid member 26 away from container 12.

The lid member 26 (FIG. 2 and 3) is a heat-sealable, flexible, opaque laminate material. In a preferred embodiment, the laminate is comprised of a outer layer of 48 gauge polyester, a 0.0005 inches 0.00127 cm.) solvent adhesive layer for binding the outer polyester layer to a 0.0005 inches (0.00127 cm) annealed aluminum foil (matte side out) layer, a 0.0005 inches (0.00127 cm.) solvent adhesive layer for binding the aluminum foil layer to a 0.003 inches 0.00762 cm.) coextruded polymeric material layer. The co-extruded polymeric material is comprised of 0.001 inches 000254 cm.) natural linear low density polyethylene (LLDPE), 0.001 inches (0.00254 cm.) black low density polyethylene (LDPE) (6% carbon load by weight), and a 0.001 inches 0.00254 cm.) heat sealable copolymer. The coextruded polymeric layer of the laminate is placed in bonded contact, preferably by heat sealing, with the flange 40, of the container as shown in FIG. 2. The preferred lid material is a product of the Archer Co. located in Winston Salem, N.C. The polyester outer layer may be replaced by oriented polyester, oriented polypropylene, oriented nylon, cast nylon, paper or coextruded film. The foil, which imparts "deadfold," i.e., the ability to retain a preselected fold, and moisture barrier properties, may be replaced by vacuumdepositing a thin layer of aluminum or silicon dioxide onto the polyester. Alternatively, a non-foil laminate utilizing poly(vinlyidene) dichloride or another suitable moisture barrier material may be utilized in this embodiment. Moreover, the adhesive layer may be a low density polyethyelene (LDPE), linear low density polyethylene (LLDPE), ethylene acrylic acid (EAA), Surlyn® (Dow), ethylene vinyl acetate (EVA), oriented states of the foregoing, or a co-extruded film. The overall laminate thickness may be in the range from 0.0030 inches (0.00762 cm.) to about 0.0050 inches 0.01270 cm.), preferably 0.0045 inches (0.01430 cm.). In the preferred embodiment, lid member 26 is heat sealed to flange 42 of container 12 such that a hermetic seal is obtained. Lid member 26, having comparable moisture and light barrier properties as container 12, allows the attainment of a hermetic barrier package 10 when the lid member 26 is sealed to flange 42 of container 10. Further, lid member 26 can be reverse-printed or surface printed with graphic information. Lid member 26 can therefore act as an advertising medium for the display of pertinent product information.

The invention has thus been described in detail with particular reference to preferred embodiments thereof, but it will be understood that variations and modifications can be effected within the spirit and scope of the invention.

What is claimed:

1. A package containing photographic film magazines, in an environment substantially free of moisture, dirt, and light, and wherein said photographic film magazines each comprises a pair of end portions, one of said pair of end portions of each said photographic film magazine having a hub extending axially therefrom, the package further comprising:

a single container having an openable end and a base, said base supporting a pair of opposed end walls interconnected with and substantially normal to adjacent opposed side walls, each said side walls having a plurality of corresponding spaced-apart substantially U-shaped recess portions defining chambers, and wherein each said recess portions in one side wall comprises a width slightly less than the diameter of one said end portion of each of said photographic film magazines and each said recess portions in said opposed side wall has a width slightly less than the diameter of said hubs for frictionally retaining said end portions and said hubs of each of said photographic film magazines such that said photographic film magazines resist movement and are spatially separated from one another to avoid contact in said container; and, a lid member adapted to resist moisture and light in bonding contact with the top edge of said openable end of said container for sealing the photographic film magazines therein.

2. The package recited in claim 1 wherein said lid member is hermetically sealed to the top edge of the openable end of said container.

3. The package recited in claim 1 wherein said lid member comprises a flexible opaque, organic laminate material capable of resisting light and moisture.

4. The package recited in claim 1 wherein the container comprises a thermoformable organic polymeric material capable of resisting moisture and light.

* * * * *